United States Patent [19]

Molter

[11] Patent Number: 4,921,586

[45] Date of Patent: May 1, 1990

[54] ELECTROLYSIS CELL AND METHOD OF USE

[75] Inventor: Trent M. Molter, Enfield, Conn.

[73] Assignee: United Technologies Corporation, Hartford, Conn.

[21] Appl. No.: 331,454

[22] Filed: Mar. 31, 1989

[51] Int. Cl.[5] ..... C25B 3/00; C25B 9/00

[52] U.S. Cl. ..... 204/72; 204/263

[58] Field of Search ..... 204/72, 77, 263, 265, 204/266

[56] References Cited

U.S. PATENT DOCUMENTS

| | | | |
|---|---|---|---|
| 3,585,079 | 6/1971 | Richter et al. | 136/86 A |
| 3,773,878 | 11/1973 | Jahnke | 204/49 |
| 3,992,271 | 11/1976 | Danzig et al. | 204/129 |
| 4,179,350 | 12/1979 | Deborski | 204/284 |
| 4,187,350 | 2/1980 | McIntyre et al. | 429/45 |
| 4,252,875 | 2/1981 | Venkatasetty | 429/196 |
| 4,294,608 | 10/1981 | Sedlak et al. | 75/0.5 |
| 4,380,576 | 4/1983 | Yoshida et al. | 429/27 |
| 4,405,693 | 9/1983 | Doddapaneni | 429/101 |
| 4,407,907 | 10/1983 | Takamura et al. | 429/42 |
| 4,510,214 | 4/1985 | Crouse et al. | 429/43 |
| 4,520,086 | 5/1985 | Skotheim | 429/192 |
| 4,556,614 | 12/1985 | le Mehaute et al. | 429/191 |
| 4,584,251 | 4/1986 | Hunziker | 429/191 |
| 4,609,441 | 9/1986 | Frese, Jr. et al. | 204/77 |
| 4,710,437 | 12/1987 | Doddapaneni | 429/101 |

OTHER PUBLICATIONS

M. Ulman, B. Avrian-Blajeni, M. Halmann; Fuel from $CO_2$: An Electrochemical Study; Apr. 1984.

A. H. A. Tinnemans, T. P. M. Koster, D. H. M. W. Thewissen, A. Mackor; Tetraaza-Macrocylic Cobalt (II) and Nickel (II) Complexes as Electron-Transfer Agents in the Photo(Electro) Chemical and Electrochemical Reduction of Carbon Dioxide; Mar. 1984.

Ronald Cook, Robert C. MacDuff, Anthony F. Sammelk;/ Ambient Temperature Gas Phase $CO_2$ Reduction to Hydrocarbons at Solid Polymer Electrolyte Cells; Jun. 1988.

Solid Polymer Electrolyte Technology for Carbon Dioxide Removal Reduction; Jan. 1983.

*Primary Examiner*—T. M. Tufariello

[57] ABSTRACT

The present invention discloses an improved solid polymer electrolysis cell for the reduction of carbon dioxide. The improvement being the use of a cathode having a metal phthalocyanine catalyst which results in the suppression of the formation of hydrogen during the reduction process and the subsequent improved conversion efficiency for carbon dioxide.

27 Claims, 1 Drawing Sheet

ELECTROLYSIS CELL AND METHOD OF USE

TECHNICAL FIELD

The technical field to which this invention pertains is electrolysis cells, in particular, electrolysis cells having solid polymer electrolyte membranes.

BACKGROUND OF THE INVENTION

The electrochemical reduction of carbon dioxide to produce organic compounds utilizing an electrolysis cell has been known for some time. Such reduction has been carried out in conventional electrolysis cells having an anode, a cathode and an electrolyte. Typically the cells are operated by passing an electric current through the anode and cathode at the same time that a fuel is brought into contact with the catalyst on the anode and a carbon dioxide containing fluid is in contact with the catalyst at the cathode. The typical fuel contains hydrogen and is either hydrogen gas or water. One such process is described in U.S. Pat. No. 4,609,441 for the production of methanol, while a second is taught for the production of hydrocarbons in the article entitled: Ambient Temperature Gas Phase CO2 Reduction to Hydrocarbons at Solid Polymer Electrolyte Cells, J. Electrochem. Soc.: Electrochemical Society and Technology, June 1988 p 1470–1471).

The problem associated with operating these devices is that it has not been possible to devise an electrolysis cell which has an adequate conversion efficiency to be of any real commercial value. This is demonstrated in the article cited above where the conversion rate of carbon dioxide to hydrocarbons is less than about 2 percent.

The present invention is directed toward improving the conversion efficiency of these electrolysis cells.

DISCLOSURE OF THE INVENTION

The present invention is directed toward an improved electrolysis cell for the reduction of carbon dioxide wherein said cell comprises an anode, a solid polymer electrolyte membrane and a cathode wherein said cathode comprises a primary carbon dioxide reducing cathode having a hydrogen overvoltage greater than platinum and further contains a secondary carbon dioxide reducing cathode having a hydrogen overvoltage greater than platinum.

Further disclosed is a method of reducing carbon dioxide utilizing said improved electrolysis cell.

The foregoing and other features and advantages of the present invention will become more apparent from the following description and drawings.

Best Mode for Carrying Out the Invention

Figure 1:
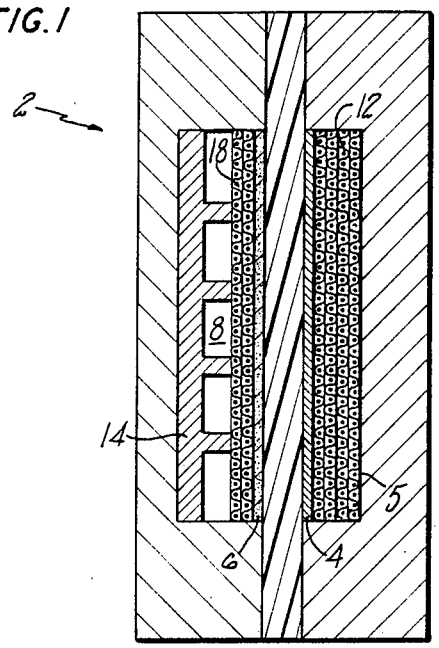
FIG. 1 depicts a cross-sectional view of one configuration of an electrolysis cell of the present invention.

FIG. 1 depicts a typical electrolysis cell 2 of the present invention containing an anode 4, an anode chamber 5, a cathode 6, a cathode chamber 8 and a solid polymer electrolyte 10 as well as current collectors 12 and 14. A typical electrolysis cell is described in commonly assigned U.S. Pat. No. 3,992,271 the teaching of which is incorporated herein.

The anodes useful in these cells are formed of conventional materials such as platinum, ruthenium or iridium. In addition, mixtures or alloys of these and other materials dispersed on a high surface area support may also be used. Conventional anodes which are particularly useful are described in commonly assigned U.S. Pat. No. 4,294,608, the teaching of which is incorporated herein as well as the aforementioned U.S. Pat. No. 3,992,271. The catalyst on the anode should be capable of high reactivity for the half cell reaction.

$$2H_2O \rightarrow 4H^+ 4e^- + O_2 \quad (1)$$

or $$H_2 \rightarrow 2H^+ + 2e^-$$

These anodes are attached to the solid polymer electrolyte using conventional techniques. This is generally achieved through the process of contacting the anode to one surface of the electrolyte membrane and causing the anode to bond to it through the application of pressure at an elevated temperature.

The electrolyte may be any of the conventional solid polymer electrolytes useful in fuel cells or electrolysis cells and capable of transporting positive ions (preferably $H^+$) from the anode to the cathode. One type is a cation exchange membrane in proton form such as Nafion (available from DuPont Corporation). Other possible electrolytes may be perfluorocarboxylic acid polymers, available from Asahi Glass and perfluorosulfonic acid polymers available from Dow Chemical. These and other solid polymer electrolyte materials are well known to those skilled in the art and need not be set forth in detail here.

The improvement to the prior art electrolysis cells comprises the selection of a primary cathode material and the introduction of a secondary carbon dioxide reducing cathode into the cell.

PRIMARY CATHODE

During the reduction of carbon dioxide in the electrolysis cell many reactions may take place at the cathode resulting in a number of possible compounds being formed. The most prevalent reaction is the reduction of carbon dioxide to formic acid set forth below $$CO_2 + 2H^+ + 2e^- \rightarrow HCOOH \quad (2)$$

However, several other reactions may take place such as the production of methanol and formaldehyde.

$$CO_2(g) + 4H^+ + 4e^- \rightarrow HCHO + H_2O \quad (3)$$

$$CO_2(g) + 6H^+ + 6^-e \rightarrow CH_3OH + H_2O \quad (4)$$

While subsequent reactions may produce other organic compounds such as methanol or methane.

$$HCOOH + 2H^+ + 2e^- \rightarrow HCHO + H_2O \quad (5)$$

$$HCOOH + 4H^+ + 4e^- \rightarrow CH_3OH + H_2O \quad (6)$$

$$HCHO + 4H^+ + 4e^- \rightarrow CH_4 + H_2O \quad (7)$$

One or more of these compounds will be generated at the cathode depending on the current density at which the cell is operated and other operating parameters of the electrolysis cell including the type and concentration of the reactants.

However, there is a reaction which readily reduces the conversion rate of the carbon dioxide at the cathode should that reaction be permitted to take place. This reaction is the formation of $H_2$ gas as shown in equation 8

$$2H^+ + 2e^- \rightarrow H_2(g) \quad (8)$$

It is believed that through the use of a cathode having a hydrogen overvoltage greater than platinum which will suppress the formation of hydrogen gas and thereby increase the amount of hydrogen ions available for reaction with the carbon dioxide, this undesirable competing reaction may be reduced.

It is a teaching of this invention that the primary cathode 6 should be formed of a material having a propensity for reducing carbon dioxide as well as a having a hydrogen overvoltage greater than platinum. Such materials are well known and have been used in similar applications. (note the article cited above from the Journal of Electrochem. in which a copper cathode is used.) as well as copending patent application filed of even date entitled Electrochemical Cell and Method of Use by Trent Molter and incorporated herein by reference. Other materials which may be used are bismuth, antimony, tin, mercury, lead, copper, zinc and cadmium, gallium, silver, gold, iron, tungsten, molybdenum and carbon. As well as organic materials such as the metal porphyrins and metal phthalocyanines. Typical metal porphyrins are aluminum and zinc. The most preferred materials are the metal phthalocyanines. Any metal phthalocyanine may be used with the preferred material being nickel phthalocyanine. Other representative metal phthalocyanines are listed in Table I below:

TABLE I

| |
|---|
| Cobalt Phthalocyanine |
| Iron Phthalocyanine |
| Copper Phthalocyanine |

These phthalocyanines will likely have the formula

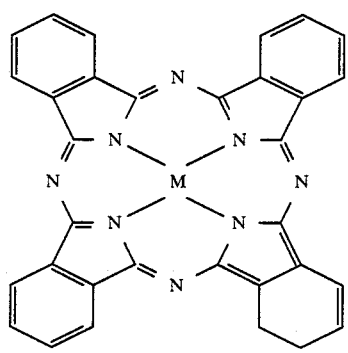

wherein M may be any metal ion. Preferably cobalt, iron, nickel or copper. It is also possible to form the cathode using a mixture of these materials or mixing them with other catalytic materials. However, it should be noted that other catalytic materials may prove detrimental to the conversion efficiency particularly if they have a low hydrogen overvoltage as it may enhance the formation of hydrogen gas.

The cathode containing these materials is formed using conventional techniques and is applied directly to the electrolyte membrane in conventional manner typically through the application of heat and pressure. Typically this means mixing the catalytic material with a binder such as polytetrafluoroethylene or other innate material which will not adversely affect the reactivity of the cathode. In general the mixture will be in a ratio of about 5 percent to about 50 percent by weight with a preferred range of from about 15 percent to about 20 percent by weight of the catalytic material, however the actual amount required will vary depending on the catalytic material chosen.

SECONDARY CATHODE

Figure 2:
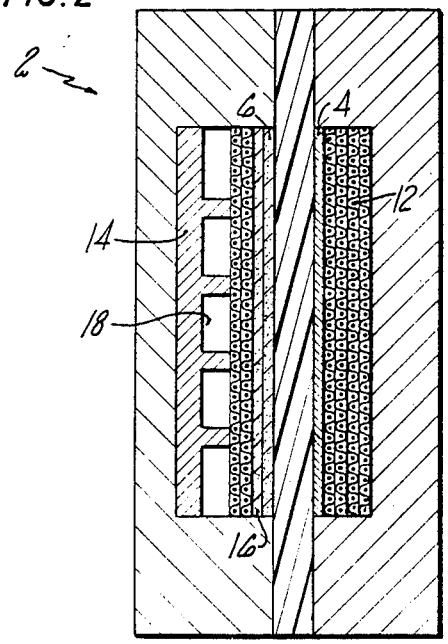
FIG. 2 depicts a cross-sectional view of a second configuration of the present invention.

In addition to the primary cathode a secondary cathode is introduced into the cell as well. This secondary cathode may be in the form of an overlay on top of the primary cathode as depicted in FIG. 2 as 16 or it may be a separate structure as shown in FIG. 1 as 18. In any configuration the secondary cathode must be in electrical contact with the primary cathode and in physical contact with the carbon dioxide and hydrogen ions. The secondary cathode is situated in the flow path of the carbon dioxide as shown in the figures and preferably supported on a plurality of fine wire mesh screens depicted in FIG. 2 as 18 or supported on a porous substrate. The secondary cathode comprises a catalytic material again having a hydrogen overvoltage greater than platinum and the propensity to reduce carbon dioxide in the presence of hydrogen ions.

These two features are important in the selection of a proper material for two reasons. One, as was discussed for the primary cathode electrode material, it is important to the improved reduction of the carbon dioxide that the formation of the hydrogen gas as shown in equation 8 be suppressed. The second feature, its propensity for the reduction of carbon dioxide in the presence of hydrogen ions results in an increase in the number of available reaction sites for this reduction to take place.

Catalytic materials which may be useful in the formation of such a secondary cathode may be inorganic metals such as ruthenium, indium, iridium, copper, or mixtures of metals such as steel or stainless steel all of which meet the two requirements for a secondary catalyst.

Organic materials may also be used just as those in the primary cathode. The organic materials of particular importance are the macromolecules such as the metal porphyrins or metal phthalocyanines discussed above for use in the primary cathode.

It is believed that the secondary catalyst offers a significant increase in the number of active sites for the reduction of carbon dioxide to take place, thereby resulting in a dramatic increase in efficiency for for the cell. The efficiency of the test cell described below increased from about 60 percent to over 90 percent through the addition of this secondary cathode.

The preferred method of manufacture for this secondary cathode, when it is in the form of a metal or metal composition, is as a fine mesh screen. This permits the cathode to have a very high surface area and is easily inserted into the cathode portion of the cell. In this form the secondary cathode may be formed of one or more of these screens.

If the material is formed of an organic material it may be pressed together to form a cathode or it may be mixed with a binder such as polytetrafluoroethylene and then pressed to form the cathode as is done for the primary cathode. Or it may be deposited on a substrate. The substrate may be formed of an inert material or it may be formed of catalytic material. Preferably the support will also have a hydrogen overvoltage greater than platinum so that it will not contribute to hydrogen gas formation. The preferred manner is to plate or deposit the material onto a support structure such as a fine mesh metallic screen. Such is the case with the preferred secondary cathode structure wherein indium is deposited onto a fine mesh stainless steel screen.

The electrolysis cells operate when a potential is generated between the anode and the cathode. The magnitude of the potential must be such that hydrogen ions are generated at the anode and carbon dioxide is reduced at the cathode. The actual voltage requirements will vary depending on a number of variables. The nature of the catalysts used in the anode and cathode are important to the voltage requirements as well as the type of anolyte or catholyte is used. For instance an anolyte of hydrogen gas would have lower voltage requirements than a anolyte composed of water. In addition, the configuration and structures of the actual cell members, i.e., flow fields, may alter the voltage requirements. Typically, these electrical requirements will range from about 2 volts to about 5 volts.

The potential may be generated by any conventional means such as general electrical sources i.e., batteries or fuel cells. In the reduction of carbon dioxide the anode will be positively charged while the cathode will be negatively charged. In addition to ionizing the hydrogen in the anolyte and reducing the carbon dioxide in the catholyte, the potential across the solid polymer electrolyte drives the hydrogen ions across the electrolyte from the anode to the cathode so that it might be available for reaction with the carbon dioxide.

The operation of the electrolysis cell during reduction of carbon dioxide is conventional. Typically, the operation entails the introduction of hydrogen or water into the anode side of the cell and carbon dioxide into the cathode side of the cell. The hydrogen gas may be introduced at ambient pressure, however, it is preferred that it be introduced at pressures greater than 50 psig, with a preferred range of 800 psig to 900 psig. While water may be introduced at ambient pressure or above with the preferred range being 800 psig to 900 psig. The carbon dioxide may be introduced as a gas mixture, as a liquid, or dissolved in an aqueous solution such as lithium carbonate or other form which does not impair the function of the solid polymer electrolyte membrane (i.e., too cold or a nonaqueous solution). At the same time as the materials are being introduced into the cell an electric current is passed between the anode and the cathode sufficient enough to cause the hydrogen or water dissociate and to cause the hydrogen ions to be transported through the electrolyte to the cathode where in the presence of the primary and secondary cathode the carbon dioxide is reduced to an organic compound.

An example of an electrolysis cell of the present invention was used to reduce carbon dioxide and is described below.

EXAMPLE

An electrolysis cell for the reduction of carbon dioxide was prepared having a 0.05 $Ft^2$ cathode of nickel phthalocyanine and teflon in a mixture of 85% to 15% by weight pressed onto the electrolyte. In addition a secondary cathode was utilized in the form of 6–40 mesh 316 stainless steel screens electroplated with indium. In addition an Indium plate was tack welded to the fluid distribution plate formed from the collector plate to promote fluid turbulence in the carbon dioxide flow and improve the contact with the two cathodes.

A solution of Argon in equilibrium with 0.1 Molar lithium carbonate was passed over the anode at a pressure of 300 psig at a flow rate of about 200 to 500 $cm^3$/min While a solution of carbon dioxide in equilibrium with 0.1 Molar lithium carbonate at a pressure of 325 psig and a flow rate of about 200 to 500 $cm^3$/minute. The cell was operated at a current density of 50 amperes per square foot for 42 minutes at a temperature between 75° F. and 100° F.

Samples of the recirculated lithium carbonate solution were taken from the cathode portion of the cell and analyzed for organic liquid reactants using an ion chromatograph. The results showed the presence of 2103 parts per million formic acid, which after a mass balance resulted in an efficiency of conversion for the carbon dioxide to formic acid of 90 percent.

Although the invention has been shown and described with respect to detailed embodiments thereof, it will be understood by those skilled in the art that various changes in form and detail thereof may be made without departing from the spirit and scope of the invention.

I claim:

1. An improved electrolysis cell for the reduction of carbon dioxide having an anode, a cathode and a solid polymer electrolyte, the improvement comprising a primary carbon dioxide reducing cathode containing a catalytic material having a hydrogen overvoltage greater than platinum and a secondary carbon dioxide reducing cathode having a hydrogen overvoltage greater than platinum thereby resulting in the suppression of the formation of hydrogen gas and improved efficiency for the reduction of carbon dioxide.

2. The cell of claim 1 wherein the secondary catalyst is in the form of one or more screens.

3. The cell of claim 2 wherein the screens comprise stainless steel, copper, brass, niobium, zirconium, or titanium.

4. The cell of claim 3 wherein the secondary catalyst comprises a screen comprising a carbon dioxide reducing material having a hydrogen overvoltage greater than platinum wherein said screen is substantially coated with a carbon dioxide reducing catalyst having a hydrogen overvoltage greater than platinum.

5. The cell of claim 4 wherein the coating catalyst is a metal.

6. The cell of claim 4 wherein the coating is indium.

7. The cell of claim 4 wherein the coating catalyst is a metal porphyrin.

8. The cell of claim 4 wherein the coating is a metal phthalocyanine.

9. The cell of claim 8 wherein the metal phthalocyanine is selected from the group consisting of iron, copper, nickel and cobalt phthalocyanine.

10. The cell of claim 8 wherein the metal phthalocyanine is nickel phthalocyanine.

11. The cell of claim 1 wherein the primary cathode comprises a metal phthalocyanine.

12. The cell of claim 11 wherein the metal phthalocyanine is nickel phthalocyanine.

13. The cell of claim 6 wherein the primary cathode comprises a metal phthalocyanine.

14. The cell of claim 13 wherein the metal phthalocyanine is nickel phthalocyanine.

15. A method for reducing carbon dioxide in an electrolysis cell having an anode a cathode and a solid polymer electrolyte comprising;

contacting the anode with a hydrogen containing material, converting said hydrogen containing material to hydrogen ions, transporting said hydrogen ions through the solid polymer electrolyte to the cathode;

contacting the cathode with carbon dioxide;

thereby causing the carbon dioxide to react with the hydrogen ions to form organic compounds wherein the improvement comprises a cathode having a primary and secondary cathode wherein said primary cathode comprises a metal phthalocyanine and said secondary cathode comprises materials capable of reducing carbon dioxide and also having a hydrogen overvoltage greater than platinum.

16. The method of claim 11 wherein the metal phthalocyanine is selected from the group consisting of iron, nickel, copper and cobalt phthalocyanine.

17. The method of claim 12 wherein the secondary catalyst is in the form of one or more screens.

18. The method of claim 14 wherein the secondary catalyst is formed from a material selected from the group consisting of tin, lead, copper, zinc, cadmium, gallium, silver, gold, indium, iron, tungsten, molybdenum and carbon.

19. The method of claim 14 wherein the screen is substantially coated with a metal porphyrin.

20. The method of claim 12 wherein the screen is coated with a metal phthalocyanine.

21. The method of claim 17 wherein the metal phthalocyanine is selected from the group consisting of iron, nickel, copper and cobalt.

22. The method of claim 17 wherein the metal phthalocyanine is nickel phthalocyanine.

23. The method of claim 14 wherein the coating comprises indium, tin, lead, copper, zinc, cadmium, gallium, silver, gold, iron, tungsten, molybdenum, or carbon.

24. The method of claim 11 wherein the carbon dioxide material is at a pressure greater than 100 pounds per square inch.

25. The method of claim 11 wherein the carbon dioxide material is at a pressure greater than 500 psi.

26. The method of claim 11 wherein the carbon dioxide material is at a pressure of between 200 and 1000 psi.

27. The method of claim 11 wherein the pressure of the carbon dioxide material in contact with the cathode is about 600 psi to about 900 psi.

* * * * *